US006240989B1

(12) United States Patent
Masoud

(10) Patent No.: US 6,240,989 B1
(45) Date of Patent: Jun. 5, 2001

(54) BUSINESS CARD HOLDER AND DISPENSER

(76) Inventor: Mahmoud Masoud, 6046 Maury Ave., Woodland Hills, CA (US) 91367

( * ) Notice: Subject to any disclaimer, the term of this patent is extended or adjusted under 35 U.S.C. 154(b) by 0 days.

(21) Appl. No.: 09/114,772

(22) Filed: Jul. 14, 1998

(51) Int. Cl.[7] ..... A45C 11/18; B65D 83/08

(52) U.S. Cl. ..... 150/149; 206/37; 206/39; 220/833

(58) Field of Search ..... 150/147, 137; 206/37, 39; 220/833, 834

(56) References Cited

U.S. PATENT DOCUMENTS

| | | | | |
|---|---|---|---|---|
| 1,467,838 | * | 9/1923 | Cook | 206/39 |
| 1,624,719 | * | 4/1927 | Dixon | 206/39 |
| 2,604,205 | * | 7/1952 | Patterson | 206/37 X |
| 3,086,676 | * | 4/1963 | Dilatush | 220/833 |
| 3,966,083 | * | 6/1976 | Hoffman et al. | 220/833 |
| 4,331,168 | * | 5/1982 | Hatakeyama | 206/37 X |
| 4,674,628 | * | 6/1987 | Prinsloo et al. | 206/38.1 |
| 4,768,648 | * | 9/1988 | Glass | 150/137 X |
| 4,790,435 | * | 12/1988 | Trusty | 206/39 X |
| 5,069,333 | * | 12/1991 | Chen | 150/147 X |
| 5,312,011 | * | 5/1994 | Fischer | 220/834 X |
| 5,452,793 | * | 9/1995 | Dimeo, Jr. et al. | 206/39 |
| 5,560,476 | * | 10/1996 | Lee | 206/37 X |

FOREIGN PATENT DOCUMENTS

| | | | | |
|---|---|---|---|---|
| 2580911 | * | 10/1986 | (FR) | 206/39 |

* cited by examiner

*Primary Examiner*—Sue A. Weaver
(74) *Attorney, Agent, or Firm*—Farjami & Farjami LLP

(57) ABSTRACT

The present invention is a unique business card holder and dispenser. The invention offers advantages of holding and dispensing a relatively large number of business cards, while the invention's business card holder and dispenser is small enough to fit in small spaces (such as one's pockets). Moreover, the invention offers the advantages of protecting business cards from being lost or damaged. The invention's business card holder and dispenser can be left in relatively hot environments without any damage to the business card holder and dispenser or any damage to the business cards held inside the invention's business card holder and dispenser. Further, the user can easily and conveniently use the invention's business card holder and dispenser and reach inside the business card holder and dispenser to take cards out. The invention's business card holder and dispenser is sturdy and does not break and thus does not need to be replaced. Also, the invention's business card holder and dispenser is made from plastic using an injection molding machine which makes the invention's business card holder and dispenser inexpensive to manufacture. The invention's business card holder and dispenser is comprised of a lid and a base. The lid can snap closed by pressing the lid onto two snap projections situated on the base. The lid can snap open by pushing the lid up using a finger access located on the lid. The lid moves with the aid of a hinge assembly.

6 Claims, 2 Drawing Sheets

BUSINESS CARD HOLDER AND DISPENSER

BACKGROUND OF THE INVENTION

1. Field of the Invention

The present invention relates generally to the field of containers and dispensers. In particular, the invention relates to the field of business card holders and dispensers.

2. Background Art

Containers and dispensers of various objects have always been known and used. However, what separates one container and/or dispenser from another is the specific purpose for which that particular container and/or dispenser is being used, and also the effectiveness of that particular container and/or dispenser. For example, while cup holders have been known and used for a long time, a cup holder that can be attached to a brief case is relatively new. Same can be said about business card holders and dispensers. While various types of business card holders and dispensers are known and have been used, the presently known business card holders and dispensers are ineffective for a number of reasons.

Use of business cards is common place. It is common for people of various professions and occupations to use business cards to introduce themselves to others or to use business cards as a means of keeping a record of friends and business acquaintances. Almost always business cards have a standard size of 3.5 inches by 2.0 inches. Thus, business cards can fit into one's pocket, wallet, or purse. However, to applicant's knowledge there is no specialized, sturdy, and convenient business card holder and dispenser that is inexpensive to produce and which can easily fit into one's brief case, purse, wallet, pocket, or other small spaces.

When business cards are picked up from a business card printer, they (i.e. the business cards) are usually bunched together by several means so that they can be handled with relative convenience. The business cards are placed in a box, are placed in a plastic sleeve, or are simply held together with a rubber band. The box is bulky and is typically 4 inches by 4 inches by 2.5 inches. Accordingly, it is impractical to carry business cards to business meetings in the box since the box cannot fit into a pocket, a wallet, or a purse. Moreover, since the lid of the box is not attached to its base, the business cards are not held securely in the box. In other words, the business cards can easily drop out of the box.

The plastic sleeves also have shortcomings. First, unless the plastic sleeve is almost filled to capacity, there are no means to keep the business cards in place. The reason is that the business cards inside a plastic sleeve are held in place primarily by being compressed against the top and bottom portions of the sleeve. Thus, if only one or two business cards are placed in the plastic sleeve, the business cards simply fall out of the sleeve. Second, the plastic sleeve cannot be left in hot environments such as inside a car or under the sun on a hot day. The reason is that the plastic sleeve gets warped out of shape when exposed to sun or high temperatures. Third, each plastic sleeve typically holds no more than ten business cards. Fourth, the plastic sleeve does not look elegant and may leave an impression of low quality in the minds of business acquaintances or friends.

The use of rubber bands to carry business cards also has several disadvantages. First, use of rubber bands makes it difficult to easily take cards out for the purpose of handing to various individuals. Second, some of the business cards held together by the rubber band may become loose and fall out of place. Third, rubber bands leave the business cards fully exposed to the environment and hence do not protect the business cards from getting stained or becoming damaged. Fourth, rubber bands often break which results in loss of some or all of the business cards. Fifth, use of rubber bands to hold business card together is generally not considered professional and leaves an undesirable image in the minds of one's business associates.

Some individuals place business cards inside their wallets. However, use of wallets has several drawbacks. First, because a wallet is typically placed inside one's pocket, the wallet, including the business cards, get damaged and/or warped out of shape. Second, a wallet is too bulky to carry around when one simply needs to carry a few business cards. Third, placement of business cards inside a wallet makes the wallet bulkier than an individual may want his or her wallet to be. Fourth, it is possible that business cards placed inside a wallet fall out of the wallet since the wallet may not have a specialized compartment to tightly secure the business cards from falling out. Fifth, individuals who use a purse typically do not use wallets. Thus, some individuals may simply not have a wallet to place the business cards in.

It is important to note that when a number of business cards are accumulated over time from contacts and various business associates, it becomes even more important to ensure that the business cards are not lost or damaged. None of the known methods discussed above ensures that business cards are not lost or damaged. Thus, according to the prior art methods within the knowledge of the applicant, carrying and dispensing business cards presents the unavoidable risk that valuable business cards culled over a long period of time may be easily lost.

Therefore, there is serious need in the art for a business card holder and dispenser that holds a relatively large number of business cards and which is not bulky and can fit into small spaces such as one's pocket. Moreover, there is need for a business card holder and dispenser that adequately protects business cards from being lost or damaged. Furthermore, there is need in the art for a business card holder and dispenser that can be left in relatively hot environments (such as inside a car on a hot day) without any damage to the business card holder and dispenser or any damage to the business cards held inside the business card holder and dispenser. Further, there is need in the art for a business card holder and dispenser that enables the user to easily access, use, or remove the business cards that are placed in the business card holder and dispenser. There is also need in the art for a business card holder and dispenser that is sturdy and does not break and thus does not need to be replaced. Also, there is need for a business card holder and dispenser which looks elegant and presents a professional image to business associates and acquaintances. Finally, there is need for a business card holder and dispenser that can offer all of the above advantages and which is also very inexpensive to manufacture.

SUMMARY OF THE INVENTION

The present invention is a unique business card holder and dispenser. The invention offers advantages of holding and dispensing a relatively large number of business cards, while the invention's business card holder and dispenser is small enough to fit in small spaces (such as one's pockets). Moreover, the invention offers the advantages of protecting business cards from being lost or damaged. The invention's business card holder and dispenser can be left in relatively hot environments without any damage to the business card holder and dispenser or any damage to the business cards held inside the invention's business card holder and dispenser. Further, the user can easily and conveniently use the invention's business card holder and dispenser and reach inside the business card holder and dispenser to take cards out. The invention's business card holder and dispenser is sturdy and does not break and thus does not need to be replaced. Also, the invention's business card holder and dispenser is made from plastic using an injection molding machine which makes the invention's business card holder and dispenser inexpensive to manufacture.

The invention's business card holder and dispenser is comprised of a lid and a base. The lid can snap closed by pressing the lid onto two projection-receptacle engaging mechanism situated on the base. The lid can snap open by pushing the lid up using a finger access located on the lid. The lid moves with the aid of a hinge assembly. In its preferred embodiment, the invention's business card holder and dispenser is made out of ABS type plastic using a 220 ton Beloit injection molding machine.

DETAILED DESCRIPTION OF THE INVENTION

The present invention is a business card holder and dispenser. Although the invention is described with respect to certain specific embodiments, the principles of the invention, as defined by the claims appended herein, can obviously be applied beyond the specifically described embodiments. Moreover, in the description of the present invention, certain details have been left out in order to not obscure the inventive aspects of the invention. The details left out are within the knowledge of a person of ordinary skill in the art and can be filled in by such a person.

Figure 1:
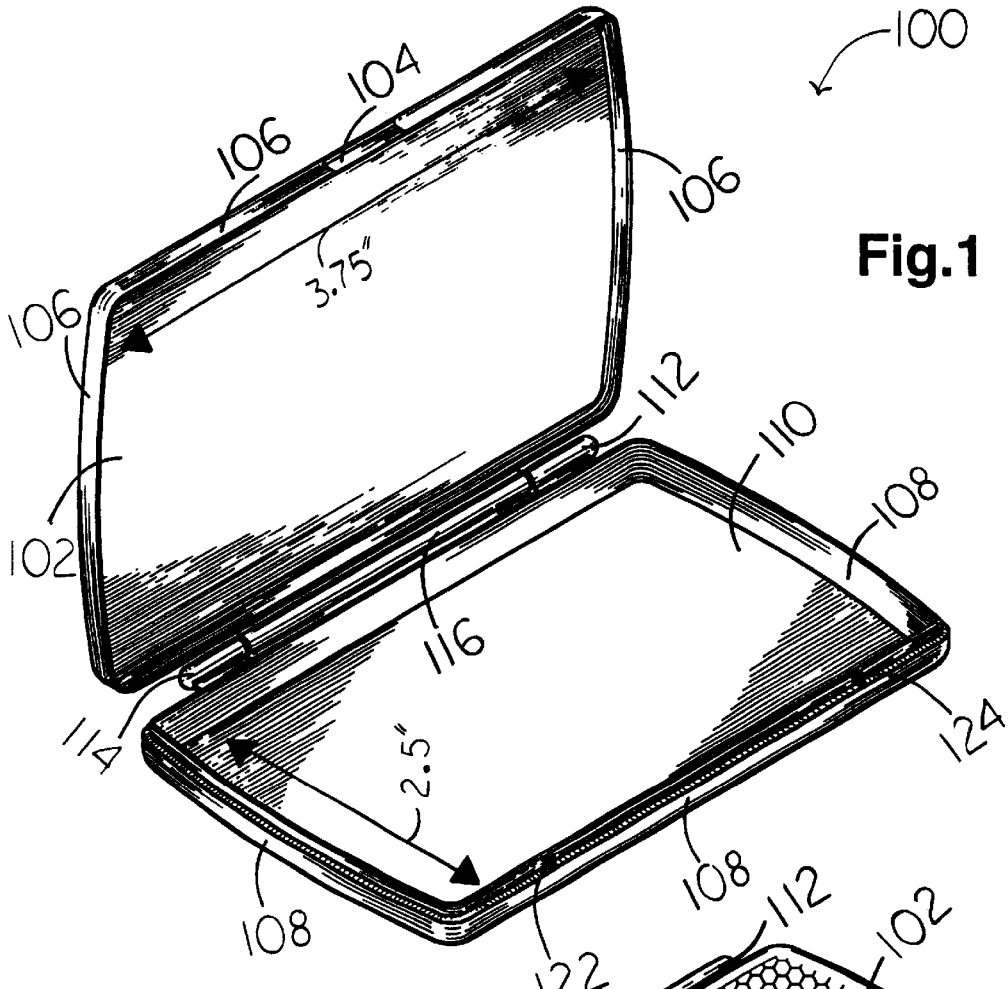
FIG. 1 shows a perspective view of the present invention's business card holder and dispenser with its lid in the open position.

FIG. 1 shows a perspective view of the present invention's business card holder and dispenser 100 while lid 102 of business card holder and dispenser 100 is open. As shown in FIG. 1, the invention's business card holder and dispenser 100 comprises lid 102, upper rim 106, finger access 104, central hinge 116, first side hinge 112, second side hinge 114, base 110, lower rim 108, first projection-receptacle engaging mechanism 122 and second projection-receptacle engaging mechanism 124. As shown in FIG. 1, first projection-receptacle engaging mechanism 122 and second projection-receptacle engaging mechanism are located on the outer surface of lower rim 108. It is noted that the combination of central hinge 116, first side hinge 112, and second side hinge 114 is also referred to as a "hinge assembly" in the present application.

Figure 2:
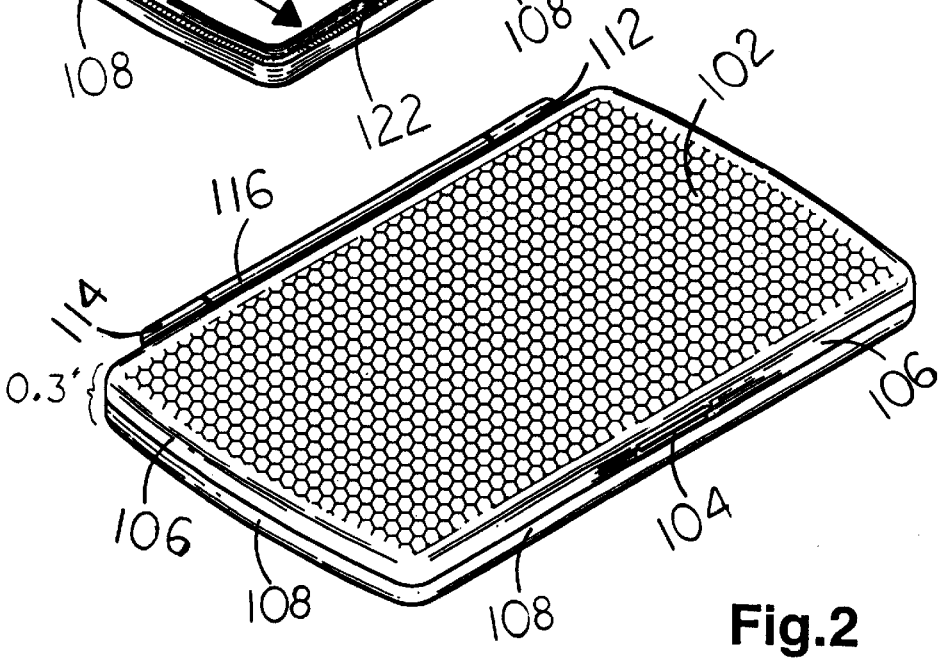
FIG. 2 shows a perspective view of the invention's business card holder and dispenser with its lid in the closed position.

FIG. 2 shows a perspective view of the invention's business card holder and dispenser 100 while lid 102 of business card holder and dispenser 100 is closed. FIG. 2 shows lid 102, upper rim 106, finger access 104, central hinge 116, first side hinge 112, second side hinge 114, and lower rim 108.

Figure 3:
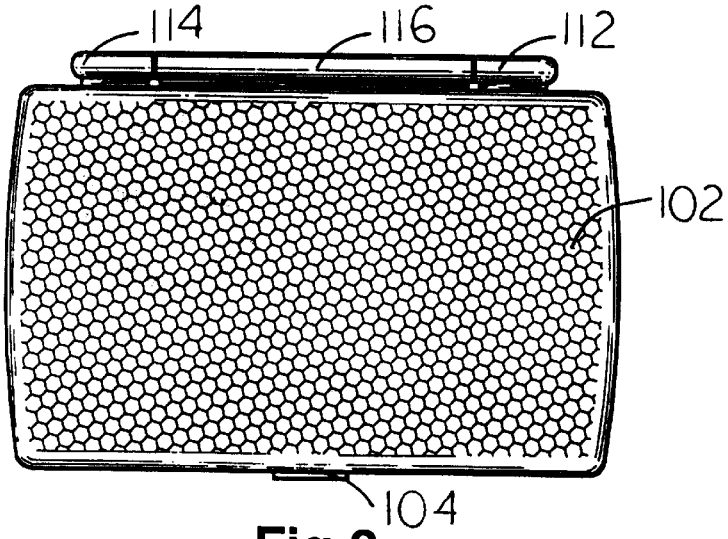
FIG. 3 shows a top view of the invention's business card holder and dispenser with its lid in the closed position.

FIG. 3 shows a top view of the invention's business card holder and dispenser 100 while lid 102 is closed. FIG. 3 shows lid 102, finger access 104, central hinge 116, first side hinge 112, and second side hinge 114.

Figure 4:
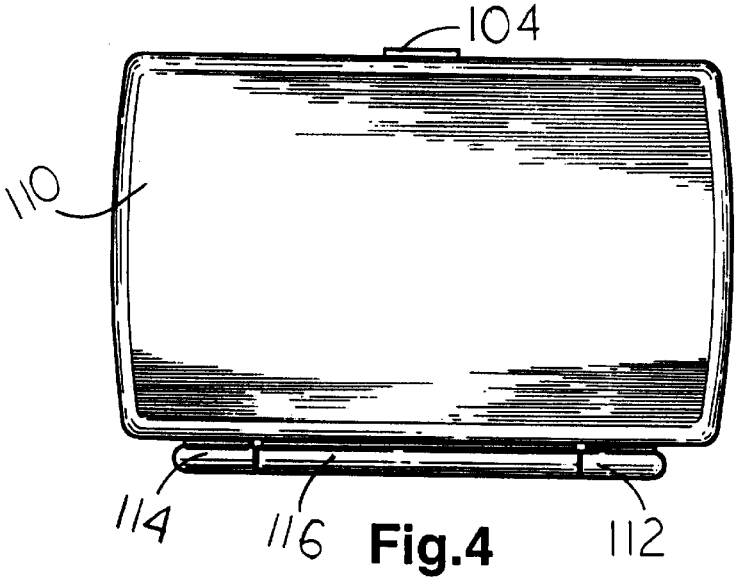
FIG. 4 shows a bottom view of the invention's business card holder and dispenser with its lid in the closed position.

FIG. 4 shows a bottom view of the invention's business card holder and dispenser while lid 102 is closed. FIG. 4 shows finger access 104, central hinge 116, first side hinge 112, second side hinge 114, and base 110.

Figure 5:
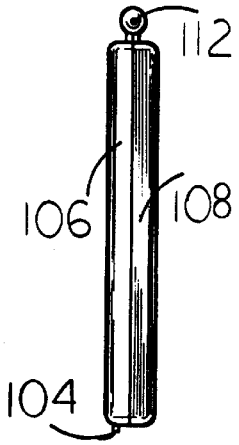
FIG. 5 shows a first side view of the invention's business card holder and dispenser with its lid in the closed position.

FIG. 5 shows a first side view of the invention's business card holder and dispenser while lid 102 is closed. FIG. 5 shows upper rim 106, finger access 104, first side hinge 112, and lower rim 108.

Figure 6:
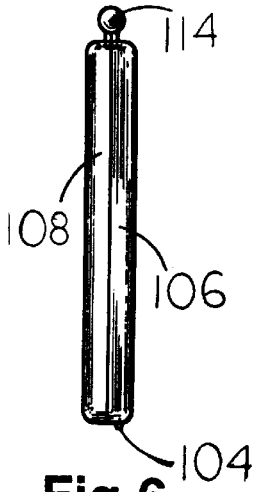
FIG. 6 shows a second side view of the invention's business card holder and dispenser with its lid in the closed position.

FIG. 6 shows a second side view of the invention's business card holder and dispenser while lid 102 is closed. FIG. 6 shows upper rim 106, finger access 104, second side hinge 114, and lower rim 108.

Figure 7:
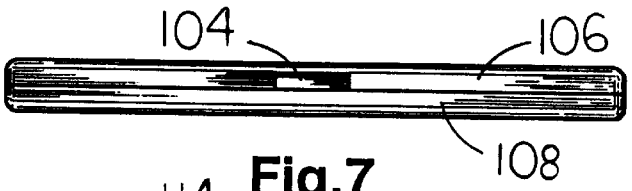
FIG. 7 shows a front view of the invention's business card holder and dispenser with its lid in the closed position.

FIG. 7 shows a front view of the invention's business card holder and dispenser while lid 102 is closed. FIG. 7 shows upper rim 106, finger access 104, and lower rim 108.

Figure 8:
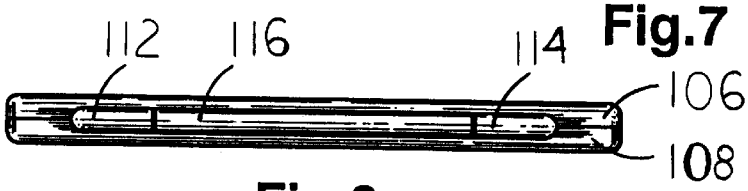
FIG. 8 shows a rear view of the invention's business card holder and dispenser with its lid in the closed position.

FIG. 8 shows a rear view of the invention's business card holder and dispenser when lid 102 is closed. FIG. 8 shows upper rim 106, central hinge 116, first side hinge 112, second side hinge 114, and lower rim 108.

In its preferred embodiment, the invention's business card holder and dispenser 100 shown in FIGS. 1 through 8 is fabricated by a plastic injection machine using ABS type plastic. For example, a 220 ton injection molding machine made by Beloit corporation can be used. The ABS type plastic used in the 220 ton Beloit injection molding machine is commercially referred to as Polylac PA-737. ABS type plastic is a type of plastic known to a person of average skill and knowledge in making articles of manufacture or machines by using plastic injection molding machines.

The plastic used in the injection molding machine of the present invention is typically a black plastic. However, a natural color plastic may be used and mixed with a desired color such as black, brown, or other colors. According to the preferred embodiment of the present invention, lid 102, base 110, first side hinge 112, central hinge 116, and second side hinge 114 are all fabricated using a single injection mold. In other words, the ensemble of lid 102, base 110, first side hinge 112, central hinge 116, and second side hinge 114 is one integrated unit derived from a single mold. However, it is also possible to fabricate a top portion comprising lid 102 and central binge 116 with a first mold and fabricate a bottom portion comprising base 110, first side hinge 112, and second side hinge 114 with a second mold. Thereafter, the top and bottom portions can be coupled to each other by engaging central hinge 116 of the top portion with first side hinge 112 and second side hinge 114 of the bottom portion.

In its preferred embodiment, the invention's business card holder and dispenser 100 is approximately 3.75 inches long, 2.5 inches wide, and 0.3 inches high. These sizes permit approximately thirty business cards of standard thickness to be contained in the invention's business card holder and dispenser 100. To arrive at these sizes (i.e. length of 3.75", width of 2.5", and height of 0.3"), a mold having these sizes is used.

An ornamental design used on the upper surface of lid 102 is achieved by using a plate having carved thereon the desired ornamental design. According to the preferred embodiment of the present invention, an ornamental design having a honeycomb-like pattern is used on the upper surface of lid 102. Similarly, an ornamental design for the bottom surface of base 110 can be achieved by using a plate having carved thereon the desired design. Alternatively, useful information such as the model number, name of the manufacturing company, and the country of manufacture can be marked on the bottom surface of base 110 using a plate carved with the desired marking information.

In operation, one or more business cards are placed on base 110 of business card holder and dispenser 100. Central hinge 116 rotates about an imaginary axis passing through first side hinge 112 and second side hinge 114. The first and second side hinges remain stationary while central hinge 116 rotates about the imaginary axis. With the aid of rotation of central hinge 116, lid 102 opens such that lid 102 can lie flat in the same plane with base 110. Central hinge 116 permits lid 102 to rotate sufficiently to bring upper rim 106 in contact with lower rim 108. When upper rim 106 has just been brought close enough to lower rim 108, the inside surface of upper rim 106 begins to contact first projection-receptacle engaging mechanism 122 and second Snap-On projection 124. Pressing lid 102 further results in the inside surface of upper rim 106 becoming fully engaged with the first and second projection-receptacle engaging mechanism on the outer surface of lower rim 108. This action results in lid 102 being snapped closed with respect to base 110.

When the user desires to remove business cards from the holder, he or she places a finger slightly under finger access 104 and while holding base 110 stationary, pushes lid 102 away from base 110 so as to disengage upper rim 106 from first and second projection-receptacle engaging mechanism on lower rim 108. This action results in lid 102 being snapped open with respect to base 110.

As stated above, when lid 102 is snapped closed, a compartment having a height of approximately 0.3 inches is created. Approximately thirty business card of standard thickness can be held in this 0.3-inch high compartment created between base 110 and lid 102 of business card holder and dispenser 100. Business card holder and dispenser 100 can fit into small spaces such as a pocket, a purse, or a wallet. Moreover, business card holder and dispenser 100 maintains business cards secure against loss and damage since the business cards are held in the closed compartment created by engagement of lid 102 and base 110.

Thus, the invention's business card holder and dispenser 100 offers a container for a relatively large number of business cards (approximately thirty) while the container is not bulky and can fit into small spaces. Moreover, the lid of the invention's business card holder and dispenser can be snapped closed and protect valuable business cards from being lost or damaged. Furthermore, the invention's business card holder and dispenser can be left in relatively hot environments (such as inside a car on a hot day) without any damage to the business card holder and dispenser or any damage to the business cards held inside the invention's business card holder and dispenser. Further, the user can easily snap open the lid of the invention's business card holder and dispenser and reach inside the business card holder and dispenser to take cards out. Another advantage of the invention's business card holder and dispenser is that it is sturdy and does not break and thus does not need to be replaced. Also, the invention's business card holder and dispenser can be manufactured with various designs on the lid and the base so that the invention's business card holder and dispenser looks elegant and presents a professional image to business associates and acquaintances. Finally and very importantly, the invention's business card holder and dispenser is made from plastic using an injection molding machine which makes the invention's business card holder and dispenser very inexpensive to manufacture while offering all of the advantages stated above.

Although the present invention has been described with reference to specific embodiments, it is appreciated by those skilled in the art that changes in various details may be made without departing from the scope and spirit of the invention as defined by the appended claims.

Thus, a business card holder and dispenser has been described.

What is claimed is:

1. A business card holder and dispenser comprising:

a lid coupled to a base by a hinge assembly;

said lid having an upper rim and said upper rim having a finger access portion;

said base having a lower rim and said lower rim having a first projection-receptacle engaging mechanism, said lid and said base forming a compartment for holding and dispensing business cards when said lid is snapped closed on said base;

said hinge assembly comprising a central hinge, a first side hinge, and a second side hinge;

said lower rim further comprising a second projection-receptacle engaging mechanism.

2. The business card holder and dispenser of claim 1 having a length of approximately 3.75 inches.

3. The business card holder and dispenser of claim 1 having a width of approximately 2.5 inches.

4. The business card holder and dispenser of claim 1 having a height of approximately 0.3 inches.

5. The business card holder and dispenser of claim 1 having a length of approximately 3.75 inches, a width of approximately 2.5 inches, and a height of approximately 0.3 inches.

6. The business card holder and dispenser of claim 1 wherein said business card holder and dispenser is made of ABS type plastic.

* * * * *